United States Patent [19]

Kirstein et al.

[11] Patent Number: 4,974,994

[45] Date of Patent: Dec. 4, 1990

[54] HYDROSTATIC DRIVE FOR WAVE GENERATING SYSTEMS IN SWIMMING POOLS

[75] Inventors: Herwig Kirstein, Lohr; Gerd Schmitt, Partenstein, both of Fed. Rep. of Germany

[73] Assignee: Mannesmann Rexroth GmbH, Lohr, Fed. Rep. of Germany

[21] Appl. No.: 287,203

[22] Filed: Dec. 21, 1988

[30] Foreign Application Priority Data

Dec. 21, 1987 [DE] Fed. Rep. of Germany ..... 3743385

[51] Int. Cl.[5] ..... E02B 3/00; F16D 31/02

[52] U.S. Cl. ..... 405/79; 60/371; 60/414; 60/473

[58] Field of Search ..... 405/75, 76, 79; 4/491; 60/371, 372, 414, 473, 476, 325

[56] References Cited

U.S. PATENT DOCUMENTS

| | | | |
|---|---|---|---|
| 3,400,636 | 9/1968 | Schneider | 60/414 |
| 3,903,696 | 9/1975 | Carman | 60/414 |
| 4,204,405 | 5/1980 | Basham | 60/371 |
| 4,406,162 | 9/1983 | Hark | 4/491 |
| 4,516,473 | 5/1985 | Oneyama et al. | 60/372 |
| 4,522,535 | 6/1985 | Bastenhof | 405/79 |
| 4,531,063 | 7/1985 | Vielmo et al. | 405/76 |
| 4,581,893 | 4/1986 | Lindbom | 60/414 |
| 4,674,280 | 6/1987 | Stuhr | 60/414 |
| 4,705,428 | 11/1987 | Anderson | 405/79 |
| 4,720,210 | 1/1988 | Stonor et al. | 405/79 |
| 4,724,692 | 2/1988 | Olmsted | 60/371 |
| 4,745,745 | 5/1988 | Hagin | 60/414 |
| 4,819,429 | 4/1989 | Korak | 60/414 |

FOREIGN PATENT DOCUMENTS

| | | | |
|---|---|---|---|
| 80/00992 | 5/1980 | PCT Int'l Appl. | 60/414 |
| 0779657 | 11/1980 | U.S.S.R. | 60/414 |
| 1027315 | 7/1983 | U.S.S.R. | 405/79 |

*Primary Examiner*—Edward K. Look
*Assistant Examiner*—Thomas Denion
*Attorney, Agent, or Firm*—Cushman, Darby & Cushman

[57] ABSTRACT

Hydrostatic drives for wave generating apparatus in swimming pools require a large amount of energy. A hydrostatic drive for the wave generating apparatus is provided which allows that part of the kinetic energy of the rearwardly moving water to be transformed into hydraulic energy, which in turn is used to impart onto the water a forward movement.

11 Claims, 3 Drawing Sheets

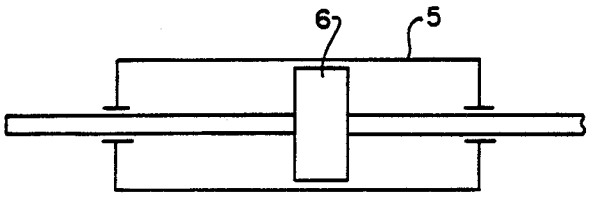
FIG. 3A
FIG. 3B
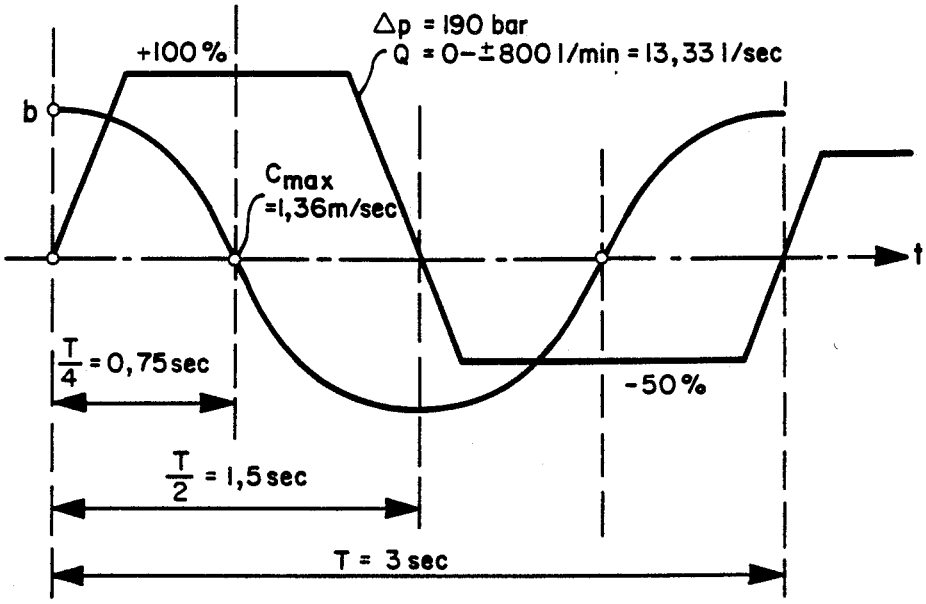
FIG. 3C
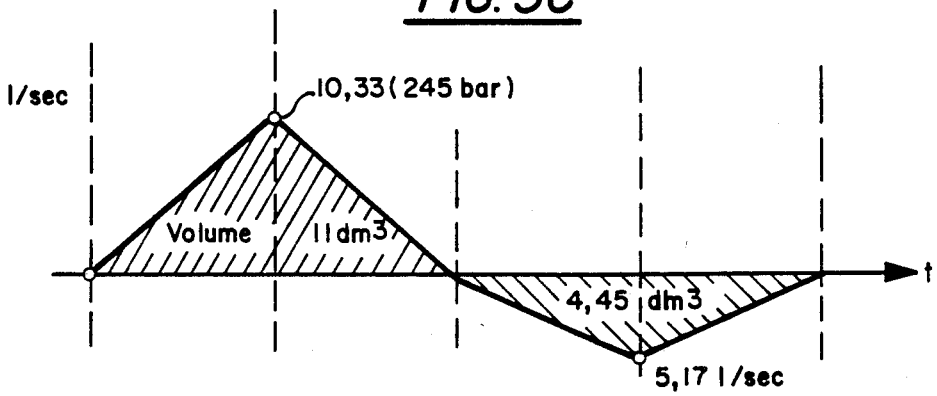

HYDROSTATIC DRIVE FOR WAVE GENERATING SYSTEMS IN SWIMMING POOLS

DESCRIPTION

1. Technical Field

This invention relates to a hydrostatic drive for wave generating systems used in swimming pools and amusement parks.

Hydrostatic drives for wave generating systems in swimming pools are known. Such a drive typically uses one or a plurality of hydraulic cylinders for reciprocating a plate means which in turn will cause by its forward and rearward movement the wave like movement of the water of the swimming pool. A hydraulic pump supplies hydraulic oil to said hydraulic cylinder(s). An electric control signal is used to control the supply of hydraulic oil to the hydraulic cylinder when responding to control means. Said electric control signal is generated and supplied by a control electronic based upon a comparison between the actual value and the desired value of the movement of said plate and the piston of the hydraulic cylinder, respectively.

U.S. Pat. Nos. 3,713 291 and 4,571 939 and German patent documents 3,714,974, 3,516,768, 3,609,399 and 3,125,754 as well as the Journal "Oelhydraulik and Pneumatik" and "Der Konstrukteur" are referred to as prior art.

The operation of the state of the art systems requires a large amount of energy. Thus, the cost for operating the wave generating system is quite high.

The present invention is directed to overcoming one or more of the problems of the prior art, specifically the problems as set forth above.

2. Disclosure of the Invention

In one aspect of the present invention, means are provided for reclaiming a large part of the energy which was imparted onto the reciprocally water moving means of the wave generating system. The reclaimed energy is then used to maintain the generation of the waves, i.e. for causing repeated movements of said water moving means.

In another aspect of the present invention the hydrostatic drive is provided with energy reclaiming means together with accumulator means for storing the reclaimed energy in the form of hydraulic energy.

In still another aspect of the present invention, a hydrostatic drive for a wave generating system is provided using the reactionary forces of the water moving means, when said means is returned to its forward position, to generate hydraulic energy. During the retraction of the hydraulic drive cylinder means hydraulic energy is transformed by means of a hydraulic transformer, said hydraulic energy being stored in a hydraulic accumulator. At a proper point in time the hydraulic energy stored in said hydraulic accumulator will then be used to generate movement of the water moving means for generating said waves.

By making use of the energy stored in the moved masses of water, up to 60% of the rated primary power can be saved compared with a conventional drive system using a pump and cylinder means in a closed oil circuit.

Preferred embodiments of the invention are disclosed in the claims.

BRIEF DESCRIPTION OF THE DRAWINGS

FIG. 3 shows diagrams for explaining the function of the invention, diagram 3A shows a synchronous cylinder, diagramm 3B is the angle by which the adjustment element (e.g. swash plate) of the second hydraulic unit is pivoted, and diagram 3C shows the loading and discharging operations of the accumulator.

BEST MODE FOR CARRYING OUT THE INVENTION

Figure 1:
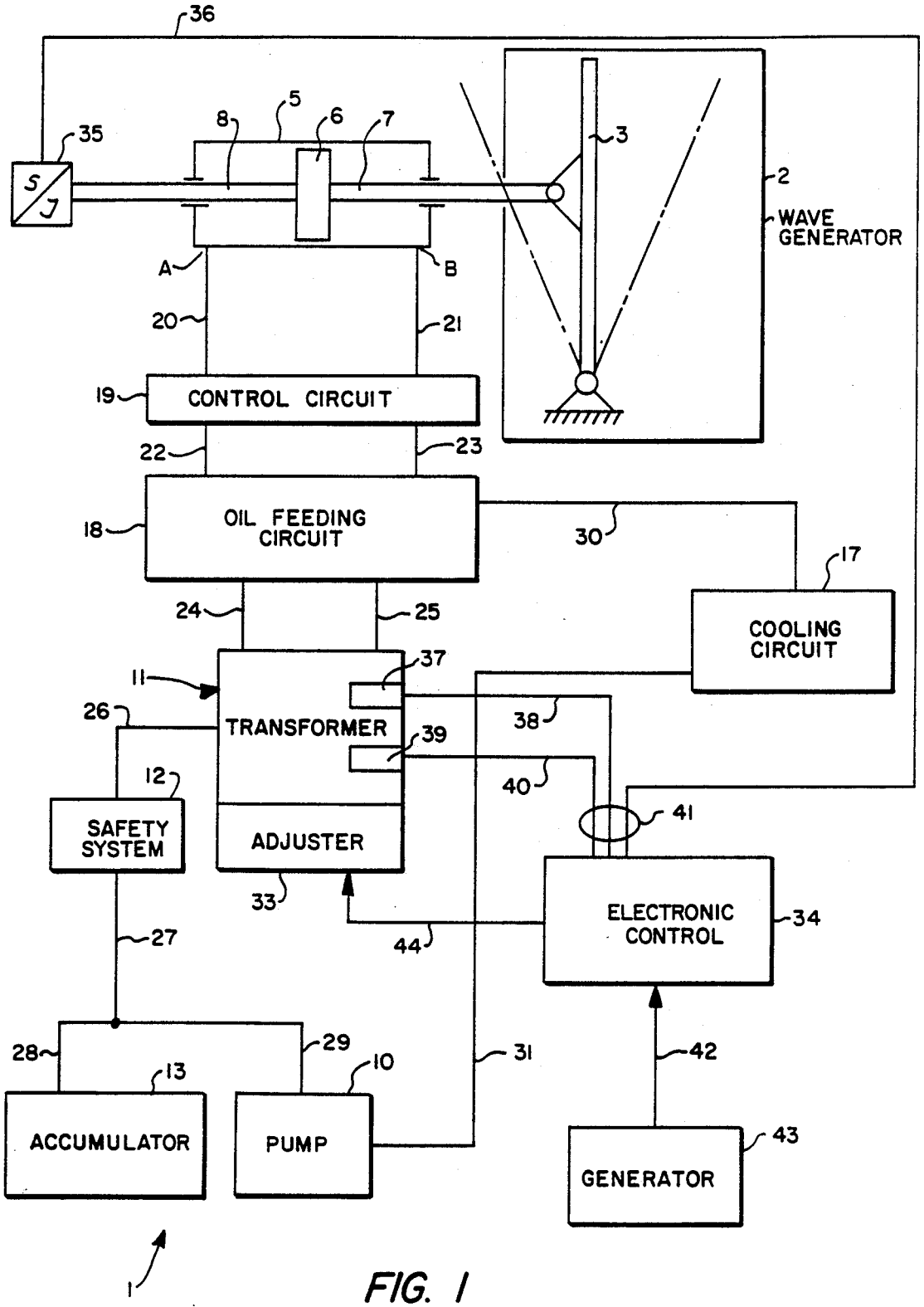
FIG. 1 is a schematic block diagram of a first embodiment of the invention of a hydrostatic drive for a wave generating system having energy feedback means.

FIG. 1 is a first embodiment of a hydrostatic drive 1 for operating a wave generating apparatus 2 intended to generate oceanlike waves in a swimming pool. The wave generating apparatus 2 comprises a water moving means (baffle plate) 3 pivotally mounted at the bottom of a swimming pool (not shown). Said baffle plate 3 is reciprocally mounted between "forward" or left and "rearward" or right (see FIG. 1) positions, with a neutral or center position inbetween.

The hydrostatic drive 1 in substance comprises hydraulic cylinder means for driving said wave generating apparatus 2. In the embodiment shown the baffle plate 3 is driven by means of a synchronous cylinder 5 coupled with said baffle plate 3. The synchronous cylinder 5 comprises a piston 6 as well as piston rods 7 and 8. The piston rod 7 is pivotally coupled to said baffle plate 3. The synchronous cylinder 5 comprises ports A and B. With regard to the term "synchronous cylinder" please see page 70 of the book "The Hydraulic Trainer" of Mannesmann Rexroth.

A pressure controlled pump 10 supplies pressure medium preferably hydraulic oil, for driving the synchronous cylinder 5.

In accordance with the invention a hydraulic storage means or accumulator 13 is connected with said synchronous cylinder 5 so as to store the kinetic energy of the water masses during one of the movements of the baffle plate 3 (typically the rearward movement). Said kinetic energy of the water masses is transformed into hydraulic energy (p.v.) in said hydraulic cylinder 5. The hydraulic energy stored in said hydraulic accumulator 13 can then be used again for driving the cylinder 5 for wave generting purposes.

A hydraulic transformer 11 is arranged between the synchronous cylinder 5 and the hydraulic accumulator means 13. The hydraulic transformer 11 transforms the pressure p of the hydraulic oil to a higher value during the rearward movement of the baffle plate for purposes of storing the oil. Following this short overview of the embodiment of FIG. 1 details will now be explained.

The ports A and B of the synchronous cylinder 5 are connected via hydraulic conduits 20, 21 with a maximum pressure control circuit 19 which in turn is connected via hydraulic conduits 22, 23 with a supply oil feeding circuit 18. The supply oil feeding circuit 18 is connected via conduits 24, 25 with the hydraulic transformer 11. The supply oil feeding circuit 18 is in turn connected via a hydraulic conduit 30 with a supply oil delivery and cooling circuit 17. Said circuit 17 is in turn connected via conduit 31 with the pressure controlled pump 10.

The hydraulic transformer 11 is connected via a hydraulic conduit 26 and a safety system 12 as well as a conduit 27 with the hydraulic accumulator (via conduit 28), and with the pressure controlled pump (via conduit 29). So as to generate substantially sine shaped waves having different amplitudes and wavelengths in a continuous way, electronic control means are provided. The electronic control means comprise an electronic control 34 in which a desired value 42 is inputted by means of a generator 43 for said desired value. The generator 43 for the desired value contains the required program for the generation of sine shaped (or also other) waves. The electronic control 34 which is supplied with said external desired value 42 carries out a comparison between said desired value and the existing value. The electronic control 34 supplies based on the comparison between said desired value and the actual value a control signal 44 to the hydraulic servo adjustment means 33 of the hydraulic transformer 11.

The actual value of the distance covered by the piston 6 and consequently by the baffle plate 3 is derived from a (first) signal and another (second) signal. The first signal comes from a distance measuring system 35 and is fed into the electronic control 34 via line 36. The another (second) signal is representative of the speed of the piston 6 and is either supplied via line 38 by an incremental means 37 located in the transformer 11, or by a tacho generator 39 also located in the hydraulic transformer 11 via a line 40.

Figure 2:
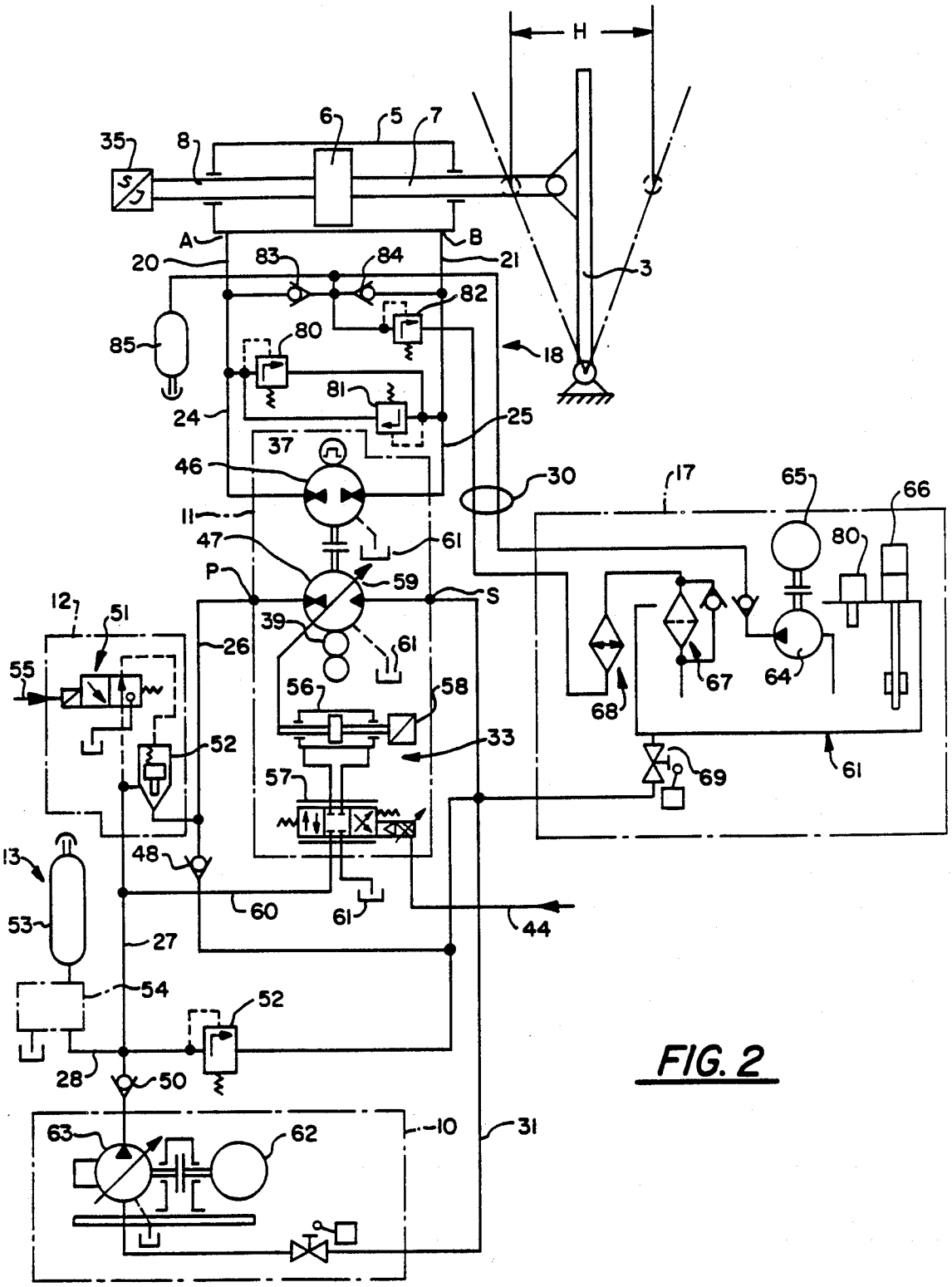
FIG. 2 is a circuit diagram of a second embodiment of a hydrostatic drive for wave generating systems having energy feedback.

FIG. 2 discloses a second embodiment of the invention which is a further modification of the embodiment of FIG. 1. In FIG. 2 the electronic control circuit is not shown to avoid an overcrowding of the drawing. As far as possible, the same reference numerals used in FIG. 1 are also used in FIG. 2.

In accordance with the invention the hydraulic transformer 11 comprises a first hydraulic unit 46 and a second hydraulic unit 47. The two hydraulic units 46 and 47 are fixedly coupled to each other. The first hydraulic unit 46 can operate as a hydraulic pump as well as a hydraulic motor. The first hydraulic unit 46 has a constant displacement volume. The first hydraulic unit 46 cooperates with the synchronous cylinder 5 in a closed oil circuit.

The second hydraulic unit 47 comprises a variable displacement volume and operates in an open circuit under secondary control. This approach is advantageous for cost reasons. The second hydraulic unit 47 can be selectively operated in a closed circuit, particularly if higher speeds are required at the second hydraulic unit 47.

The servo adjustment 33 mentioned already in connection with FIG. 1 causes in accordance with the control signal 44 the adjustment of the second hydraulic unit 46. Later on, when referring to FIG. 3 the angle of the pivotal movement of the adjustment element (for instance of the swash plate) of the second hydraulic unit 47 which is controlled from the secondary side, will be shown. The speed and the reversal of the direction of rotation and the output of the second hydraulic unit 47 is carried out depending on the speed by means of the already mentioned comparison between the actual value and the desired value, i.e. the preset external desired value 42 and the actual value. The second hydraulic unit 47 thus operates in the socalled second quadrant operation, i.e. if the direction of rotation is reversed, the volume of displacement is changed from its maximum negative value (the maximum intake volume) to its maximum positive value (the maximum output volume).

The second hydraulic unit 47 comprises a high pressure port P and a suction port S. A check valve 48 is arranged between the high pressure port P and the suction port S and serves as an after suction valve. Without the presence of the check valve 48 the second hydraulic unit 47 would cavitate in the event of a sudden closing of the safety system or safety block 12 of FIG. 1. The high pressure port P is further connected to the pressure controlled pump P via the safety system 12 and a check valve (which is part of the pump arrangement); the high pressure port P is also connected to the hydraulic accumulator arrangement.

The safety system 12 comprises a 3/2 directional poppet valve 51 and a 2/2 directional poppet valve 52. The safety system 12 has the task to separate the hydraulic accumulator means 13 from the hydraulic transformer 11, i.e. the drive system is cut off in case of an emergency or in case of a power failure. Such an emergency situation could arise for instance if the electronic control 34 fails. Normally, the safety system is in an automatic mode of operation. During said kind of operation the drive 1 operates corresponding to the control of the electronic control 34 and the safety system 12 is basically enabled, i.e. the 2/2 control valve 42 can be freely passed by the hydraulic medium from both sides. An arrow 55 indicates the control provided by the electronic control 34.

The hydraulic accumulator arrangement 13 comprises the hydraulic accumulator 53 proper as well as said accumulator safety and separating block 54.

Moreover, a pressure limiting valve 52 (which belongs to the pump arrangement) is shown together with a check valve 48 at the output of the pump. The check valve is further connected to the suction side S of the pump.

The hydraulic servo adjustment 33 comprises a control cylinder 56 for adjusting the adjustment element 59 of the second hydraulic unit 47, further a distance feedback means 58 and a servo valve 57. The servo valve 57 is controlled by control signal 44 of the control electronic 34. The control pressure required for the hydraulic servo adjustment means 33 is derived from conduit 27 via conduit 60. Further, one port of the servo valve 58 is connected to a tank 61. The reference numeral 61 is generally used for referring to a tank.

The entire pump arrangement comprises the already mentioned check valve 50 and the maximum pressure limiting valve 52 (which limits to a pressure which is about 15 to 20% of the pressure provided by the pressure controller) and the pressure controlled pump. The pressure controlled pump 10 in turn comprises a pressure controlled hydraulic pump unit 63 driven by an electromotor 62. The pressure controlled pump does not have to supply in accordance with the invention all the power required to the drive of the baffle plate 3, but has to supply only an amount which would balance the losses of power. Said losses of power occur due to leakages at the first hydraulic unit 46, the second hydraulic unit 47 and the servo valve 57. Moreover, losses occur due to the control energy at the control cylinder 56 of the second hydraulic unit 47.

Moreover, frictional losses occur in the cylinder 5 and also in the hydraulic accumulator 53 which is not 100% effective. Moreover, losses occur due to the leakage of the pump unit 63.

The occurring losses are transferred into heat. Said heat will be removed by, the pressure medium or oil feeding arrangement 17. The arrangement 17 comprises a feeding pump 64 driven by an electric motor. Also, a thermostat 80, a floater switch 66, a filter 67, an oil cooler 68 and a blocking valve 69 as well as a tank 61 are provided.

The maximum pressure limiting circuit 19 of FIG. 1 comprises in accordance with FIG. 2 maximum pressure limiting valves 80 and 81. The feeding circuit 18 of FIG. 1 comprises in accordance with FIG. 2 a feeding pressure valve 82 as well as two feeding check valves 83 and 84. The feeding oil accumulator 85 is connected in the manner shown and serves to avoid cavitation of the feeding pressure side of closed oil circuit if a sudden load occurs at the secondary side.

FIG. 3 shows the situation for an embodiment of a hydraulic drive 1 for wave generating apparatus 2. In the upper part of FIG. 3 (i.e. FIG. 3A) a hydraulic synchronous cylinder 5 is shown which comprises at both sides of the piston a volume of about 13 liters. The maximum work pressure is for instance 190 bar.

The FIG. 3B diagram below the cylinder 5 represents the cosine oscillation of the accelleration of the piston 6 during the rearward movement of the wave generating apparatus. It can be recognized that in a situation where the piston 6 is located in its very left position maximum accelleration is required, and that the accelleration decreases towards 0 for the neutral or center position of the piston 6 shown in FIG. 2. At the center position the maximum speed Cmax is reached for all practical purposes. After a time T/2 of 1.5 sec the most forward or rightward position of the piston 6 is reached.

Here exists maximum delay and a speed of 0 for all practical purposes. Thereupon, the piston 6 moves rear- or leftwardly as is shown in some detail. Diagramm 3C shows the accelleration curve and a trapezoidal curve represents the angle of the pivotal movement of the control element 59 of the second hydraulic unit 47. It can be recognized that the second hydraulic unit 47 acts initially as a motor (+100%) and subsequently as a pump (−50%).

With the expressions "100%" and "50%" the amount of the adjusted pivotal movement is referred to. This is also a measure for the suction volume.

The accumulating/charging/decharging diagram of FIG. 3C shows that during the rightward or forward movement the piston 6 removes from the accumulator 53 a volume of about 11 liters having a pressure of 245 bar. This volume is removed from the accumulator. It can also be seen that the accumulator does receive back a volume of about 4.45 liters against about 245 bar during the forward movement of the piston. This means that a substantial amount of energy is saved because for the repeated rightward (forward) and leftward (rearward) movements of the the piston 6 only the difference between 11 and 4.5 liters, i.e. 6.5 liters is required to be supplied by the pressure controlled pump 10.

We claim:

1. A hydrostatic drive for a wave generating apparatus for a swimming pool, said drive comprising:

at least one hydraulic cylinder for imparting a reciprocal movement between a forward and a rearward position to a water moving means in contact with the body of water of the swimming pool so as to cause a wave motion in said water, a hydraulic pump for supplying a hydraulic medium to said hydraulic cylinder, hydraulic control means for controlling the supply of hydraulic medium to said hydraulic cylinder, and an electronic control for generating and supplying an electric control signal to said hydraulic control means, wherein during the rearward movement of the water moving means the kinetic energy of the water acting against said water moving means is transferred to the hydraulic medium in the hydraulic cylinder and is stored in a hydraulic accumulator and the stored energy is used for the actuation of the piston of the hydraulic cylinder for the forward movement of said water moving means, wherein the hydraulic energy transferred to the hydraulic medium in the hydraulic cylinder during the rearward movement of the moving means coupled to said piston is supplied to the hydraulic accumulator by means of a hydraulic transformer with an increased pressure, wherein said hydraulic transformer comprises a first hydraulic unit and a second hydraulic unit, wherein said first hydraulic unit is adapted to operate as a pump as well as a motor and wherein during the rearward movement of the piston the pressure from a cylinder of the synchronous type as well as the pressure medium volume displaced from the synchronous cylinder drive, in said mode of operation, the first hydraulic cylinder unit, so that said first hydraulic unit drives said second hydraulic unit which is coupled with said first hydraulic unit, wherein the second hydraulic unit supplies hydraulic medium into said hydraulic accumulator in accordance with the pressure/volume characteristic of said accumulator, and wherein further during said mode of operation hydraulic pressure medium flows to said second hydraulic unit at the low pressure side thereof, said pressure medium coming from a pressure medium tank.

2. The drive of claim 1 wherein the electronic control carries out a comparison between the actual value of the movement of the water moving means and the piston of the hydraulic cylinder, respectively, with a predetermined external desired value.

3. The drive of claim 1 wherein said second hydraulic unit operates in an open circuit having a variable displacement and being controlled on a secondary side.

4. The drive of claim 1 wherein a hydraulic servo adjustment is provided for said second hydraulic unit adapted to work in a second quadrant mode of operation, for a reversal of the direction of rotation the suction volume (displacement volume) is changed from a negative maximum value to a positive maximum value passing through a 0-line.

5. The drive of claim 1 wherein a safety system is provided having the form of a safety block arranged between the pump and the hydraulic accumulator means on the one hand side and the hydraulic transformer on the other hand side.

6. The drive of claim 5 wherein the safety block is controlled to be open by the electronic control in an automatic mode of operation such that a two way poppet valve of the safety system can be passed by pressure medium (hydraulic oil) from both sides.

7. The drive of claim 1 wherein the hydraulic transformer comprises a first hydraulic unit having a constant displacement or suction volume and a second hydraulic unit having a variable suction or displacement volume, wherein both units are fixedly coupled to each other.

8. The drive of claim 7 wherein the first hydraulic unit forms together with the synchronous cylinder a closed oil circuit.

9. The drive of claim 8 wherein said hydraulic accumulator and a pressure controlled pump are directly connected to the pressure port of the second hydraulic unit, so as to accelerate the same in opposite direction such that the first constant hydraulic unit supplies fluid into the port of the synchronous cylinder to move the same in an analogous manner.

10. Drive of claim 6 wherein in a situation of emergency the safety system comprising a 3/2 control poppet valve and a 2/2 control poppet valve separates the hydraulic accumulator and the pump from the drive.

11. Drive of claim 10 wherein a check valve is provided between a high pressure port of the second hydraulic unit and the suction port of the second hydraulic unit serving as an after suction valve so as to prevent a cavitation of the second hydraulic unit in case the safety system suddenly closes.

* * * * *